US009251635B2

(12) United States Patent
Karasawa et al.

(10) Patent No.: US 9,251,635 B2
(45) Date of Patent: Feb. 2, 2016

(54) DOCUMENT RACK

(71) Applicant: JAPAN CASH MACHINE CO., LTD., Osaka (JP)

(72) Inventors: Shigeyuki Karasawa, Tokyo (JP); Tomonori Kitano, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 0 days.

(21) Appl. No.: 14/382,660

(22) PCT Filed: Mar. 5, 2013

(86) PCT No.: PCT/JP2013/001361

§ 371 (c)(1),
(2) Date: Sep. 3, 2014

(87) PCT Pub. No.: WO2013/132834

PCT Pub. Date: Sep. 12, 2013

(65) Prior Publication Data

US 2015/0170451 A1 Jun. 18, 2015

(30) Foreign Application Priority Data

Mar. 5, 2012 (JP) ..... 2012-048605

(51) Int. Cl.
*G07D 11/00* (2006.01)

(52) U.S. Cl.
CPC ..... *G07D 11/0018* (2013.01); *G07D 11/0021* (2013.01)

(58) Field of Classification Search
CPC ..... G07D 11/0006; G07D 11/0018; G07D 11/0021; G07D 11/0033; G07F 7/005; G07F 7/04; G07F 9/10; G07F 19/201; G07F 19/205
USPC ..... 194/344, 346, 350, 351, 352; 232/1 D; 211/86.01, 135; 271/278, 279; 209/534
See application file for complete search history.

(56) References Cited

U.S. PATENT DOCUMENTS 6,349,810 B1 2/2002 I-Chia
8,393,612 B2 3/2013 Nunn (Continued)

FOREIGN PATENT DOCUMENTS

JP 4-12075 U 1/1992
JP 2002099943 A 4/2002

(Continued)

OTHER PUBLICATIONS

Taiwan official action and search report for Application No. 102107641 dated Sep. 17, 2014, (3 pages).

*Primary Examiner* — Mark Beauchaine
(74) *Attorney, Agent, or Firm* — Bachman & LaPointe, P.C.

(57) ABSTRACT

A document rack is provided to comprises a front wall 4 formed with at least one opening 7, a back wall 5 formed with at least one notch 5*a*, and a bottom wall 6 for connecting lower ends of front and back walls 4, 5 to structurally constitute a housing 3. A front portion 2 of a document validator 1 may be arranged in inner chamber 10 through notch 5*a* of back wall 5 so that users can easily take out documents in a lump from a pocket 13 of the document rack for reuse of documents because pocket 13 may receive and retain documents dispensed from document validator 1 to prevent scatter and contamination of the discharged documents.

8 Claims, 11 Drawing Sheets

(56) References Cited

U.S. PATENT DOCUMENTS

| | | | | |
|---|---|---|---|---|
| 8,708,127 | B2 * | 4/2014 | Roosch | 194/206 |
| 2001/0015309 | A1 * | 8/2001 | Ikuta | 194/206 |
| 2002/0180136 | A1 | 12/2002 | Amari et al. | |
| 2005/0011723 | A1 * | 1/2005 | Singleton, III | 194/350 |
| 2005/0078864 | A1 | 4/2005 | Amari et al. | |
| 2011/0154742 | A1 | 6/2011 | Nunn | |

FOREIGN PATENT DOCUMENTS

| | | | |
|---|---|---|---|
| JP | 2003006702 | A | 1/2003 |
| JP | 2003242553 | A | 8/2003 |
| JP | 2004224476 | A | 8/2004 |
| JP | 2007004450 | A | 1/2007 |
| TW | 200600431 | | 1/2006 |
| TW | 201101237 | A | 1/2011 |
| WO | 2010025371 | A1 | 3/2010 |

* cited by examiner

DOCUMENT RACK

BACKGROUND OF THE INVENTION

The present invention comprises a document rack attached to a fore or front side of a document validator to receive and retain documents discharged from the document validator.

Typically, automated bill handling machines such as vending machines, ticket machines and bill exchangers today utilize a bill validator that has its functions to discriminate authenticity of bills slipped into an inlet of the validator, to stow the bills considered genuine into a stacker provided in the validator and to return to the inlet the bills considered counterfeit. When the bill is returned to the inlet, it is kept at the inlet with the bill whose leading edge partly projects outward from the inlet to allow users to thoroughly draw the bill out of the inlet, otherwise the bill is wholly discharged from the inlet on a tray provided in front of and adjacent to the inlet of the vending machine.

Japanese Patent Disclosure No. 2002-99943 by I. Amari et al. discloses a currency handling apparatus that comprises a casing formed at the upper portion with an inlet for receiving bills within the casing and an outlet for discharging bills from the casing, a deposits/withdrawals unit disposed at the upper portion within the casing, a base unit disposed at the lower portion within the casing, and a plurality of intermediate units disposed between the deposits/withdrawals and base units. The deposits/withdrawals unit comprises an introduction mechanism provided with a validator for introducing bills from an insertion opening at the inlet into the validator to discriminate denomination of the bills, a discharge mechanism for carrying bills to a payout opening at the outlet, and a first conveyor mechanism of forward/reverse drive selectively connected through a first switch device to the introduction or discharge mechanism to convey bills along a passageway. The base unit comprises a first stacker, a second conveyor mechanism of forward/reverse drive for carrying bills toward and away from the first stacker, and a first take-in/take-out mechanism of forward/reverse drive for receiving and removing bills between the first stacker and second conveyor mechanism. Each of the intermediate units comprises a second stacker, a third conveyor mechanism of forward/reverse drive for carrying bills toward and away from the second stacker, a second take-in/take-out mechanism of forward/reverse drive for receiving and removing bills between the second stacker and third conveyor mechanism, and a second switch device for switching the conveyance direction between the third conveyor mechanism and second take-in/take-out mechanism.

Japanese Patent Disclosure No. 2004-224476 by A. Isobe, et al. demonstrates a document handler that comprises a conveyor for transporting along a passageway a bill inserted from an inlet, a discriminator for discriminating the bill moved by the conveyor, a refuge area connected to the passageway for receiving the bill out of a detectable position by the discriminator, and a conveyance controller for controlling the drive of the conveyor to deliver to the refuge area the bill considered false and to return the bill from the refuge area to the detectable position by the discriminator for revalidation of the bill's authenticity.

Japanese Patent Disclosure No. 2003-242553 by S. Murai, et al. exhibits a bill handler that comprises an inlet assembly attached to a front side of a handler casing, a frame attached to the front side of the handler casing to surround the inlet assembly, and a front cover attached to the front side of the handler casing to cover and guard the inlet assembly and frame.

Japanese Utility Model Disclosure No. 4-12075 by A. Tomie represents a device for throwing bills into a vending machine that comprises a door provided at the front of the vending machine, a bill slot formed at an opening on the door, a cover for opening and closing the bill slot, a bill validator disposed within the door, a bill guide provided between the bill slot and bill validator, and a spring disposed between the bill guide and a damper supported by the bill slot.

Bill validators shown in these prior art documents are disadvantageous because none of them can collectively retain bills discharged from the validators while preventing scatter of the discharged bills.

An object of the present invention is to provide a document rack for receiving and retaining documents discharged from a document validator to prevent scatter of the discharged documents and their contamination resulted from the scattering. Another object of the present invention is to provide a document rack that may be detachably attached to prior art document validators. Still another object of the present invention is to provide a document rack for collectively receiving and retaining valuable documents considered genuine and yet reusable by and dispensed from a document validator.

SUMMARY OF THE INVENTION

The document rack according to the present invention comprises a front wall (4) formed with an opening (7), a back wall (5) formed with a notch (5*a*), and a bottom wall (6) connected to a lower end of back wall (5) to constitute a housing (3). Housing (3) has an inner chamber (10) at the upper portion for receiving a front portion (2) of a document validator (1) and a pocket (13) at the lower portion for receiving documents discharged from document validator (1). Front portion (2) of document validator (1) may be arranged in inner chamber (10) through notch (5*a*) of back wall (5) so that users can insert documents through opening (7) of front wall (4) into an inlet port (11) provided in front portion (2) of document validator (1). Pocket (3) of housing (3) may receive and retain documents dispensed from document validator (1) to prevent scatter and contamination due to the scattering of discharged documents from the rack. In addition, users can easily take out documents in a lump from pocket (13) for reuse of documents. Thus, the document rack makes it easier for users to handle documents discharged from document validator (1).

BRIEF DESCRIPTION OF THE DRAWINGS

The above-mentioned and other objects and advantages of the present invention will be apparent from the following description in connection with preferred embodiments shown in the accompanying drawings wherein.

DETAILED DESCRIPTION

Figure 1:
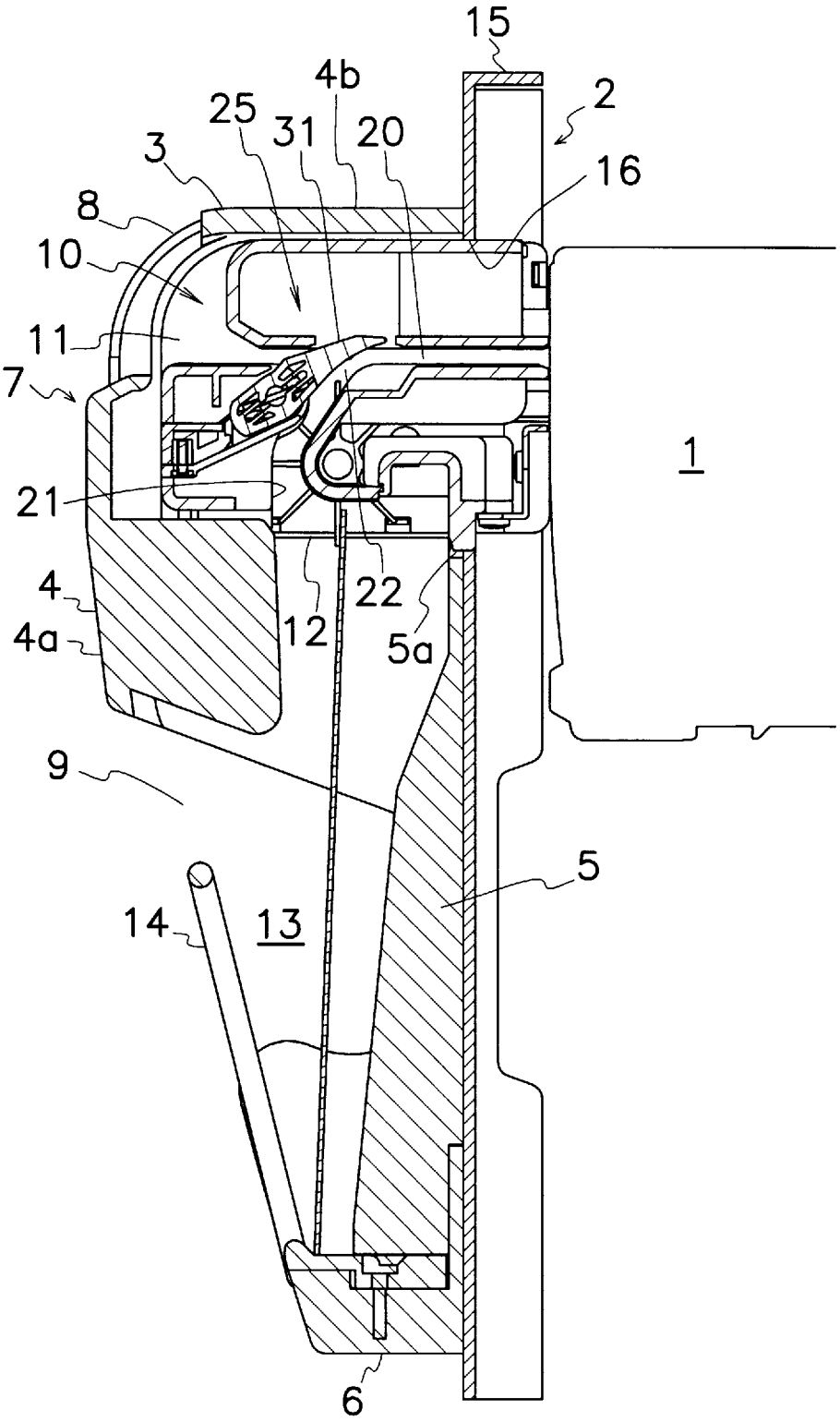
FIG. 1 is a partial sectional view of the document rack according to the present invention attached to a panel.
Figure 2:
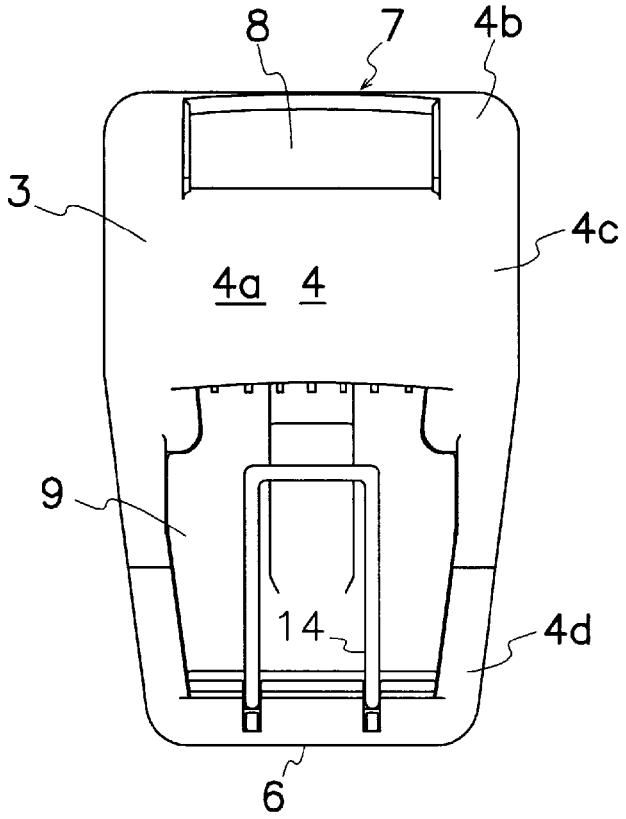
FIG. 2 is a front view of the document rack.
Figure 3:
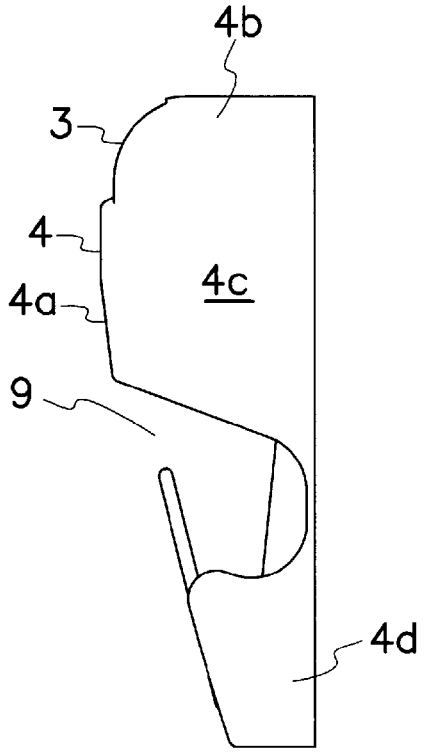
FIG. 3 is a side elevation view of the document rack.
Figure 4:
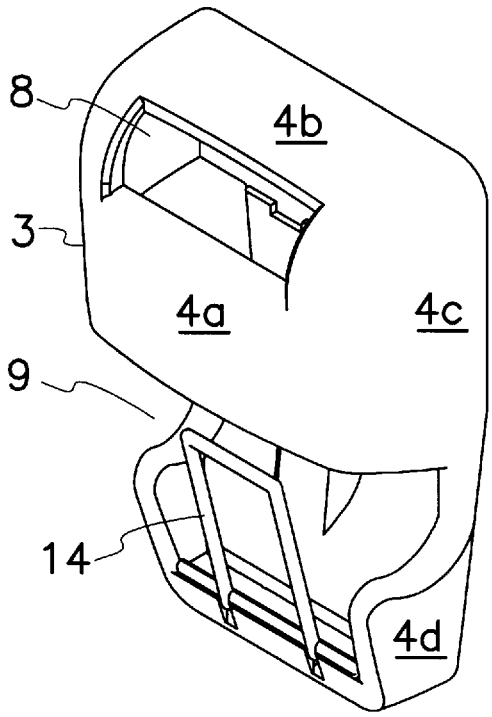
FIG. 4 is a perspective view of the document rack.

Embodiments of the document rack according to the present invention will be described hereinafter in connection with FIGS. 1 to 16 of the drawings. Same reference symbols shown in FIGS. 1 and 16 indicate identical or similar portions in these drawings. The term "a document" or "documents" herein broadly means all or any of valuable papers including bills, currencies, plastic money, coupon tickets, tokens, tenders, credit cards, securities and scrip while the embodiments of the invention exemplifies bills dealt for bill validators.

The document rack according to the present invention has a housing 3 attached to a front side of a shield such as a door panel 15 of a gaming or vending machine by a suitable known fixing device such as bolts and nuts while a bill validator 1 is attached to a back side of door panel 15 to arrange a front portion 2 of bill validator 1 within housing 3.

Housing 3 comprises a front wall 4 formed with an opening 7, a back wall 5 formed with a notch 5*a*, and a bottom wall 6 connected to a lower end of back wall 5 to structurally constitute housing 3 by front, back and bottom walls 4, 5 and 6. Front wall 4 comprises a generally flat anterior wall 4*a*, a top wall 4*b* that has a curved top portion smoothly extending from anterior wall 4*a* and a horizontal top rear portion connected to the curved top portion and back wall 5, a pair of side walls 4*c* that each have a curved side portion smoothly extending from anterior wall 4*a* and a vertical rear portion connected to the curved side portion and a side of back wall 5. Each of side walls 4*c* has a curved lower side wall 4*d* connected between anterior wall 4*a* and bottom wall 6.

An inner chamber 10 is formed at the upper portion within housing 3 by anterior wall 4*a*, top wall 4*b*, side walls 4*c* and back wall 5, and a pocket 13 is formed below inner chamber 10 within housing 3 by anterior wall 4*a*, bottom wall 6, lower side walls 4*d* and back wall 5. Opening 7 formed on front wall 4 comprises an inlet opening 8 formed on anterior wall 4*a* and a discharge opening 9 below inlet opening 8. Removably attached to bottom wall 6 is an inverted channel-shaped guard fence 14 that compensates discharge opening 9 of front wall 4 to ensure prevention of bills from dropping out of pocket 13 between guard fence 14 and back wall 5. Pocket 13 serves to receive and retain bills that fall from outlet port 12 of front portion 2 of bill validator 1 and guard fence 14 also makes it easier for users to observe and access bills in pocket 13.

Figure 5:
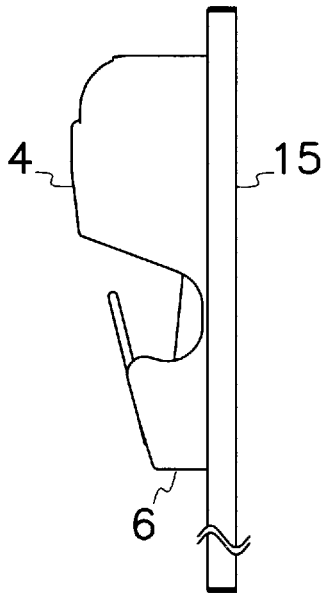
FIG. 5 is a side elevation view of the document rack attached to the panel.
Figure 6:
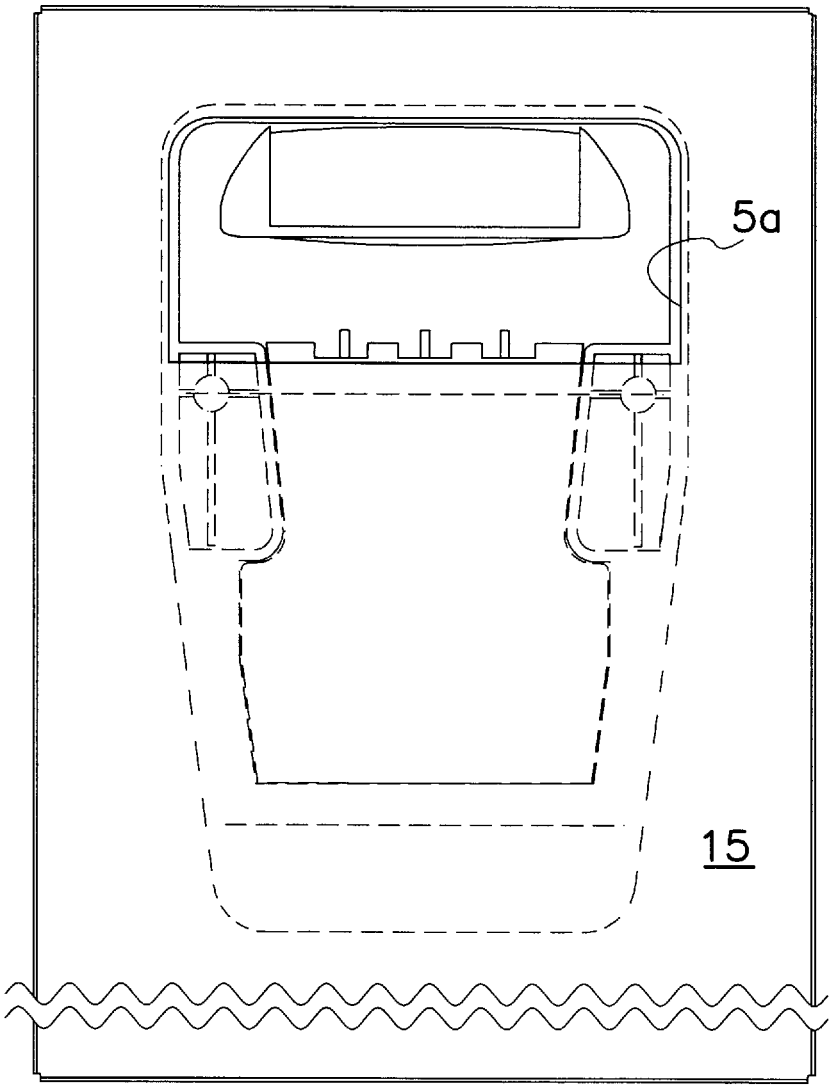
FIG. 6 is a back view of FIG. 5.
Figure 10:
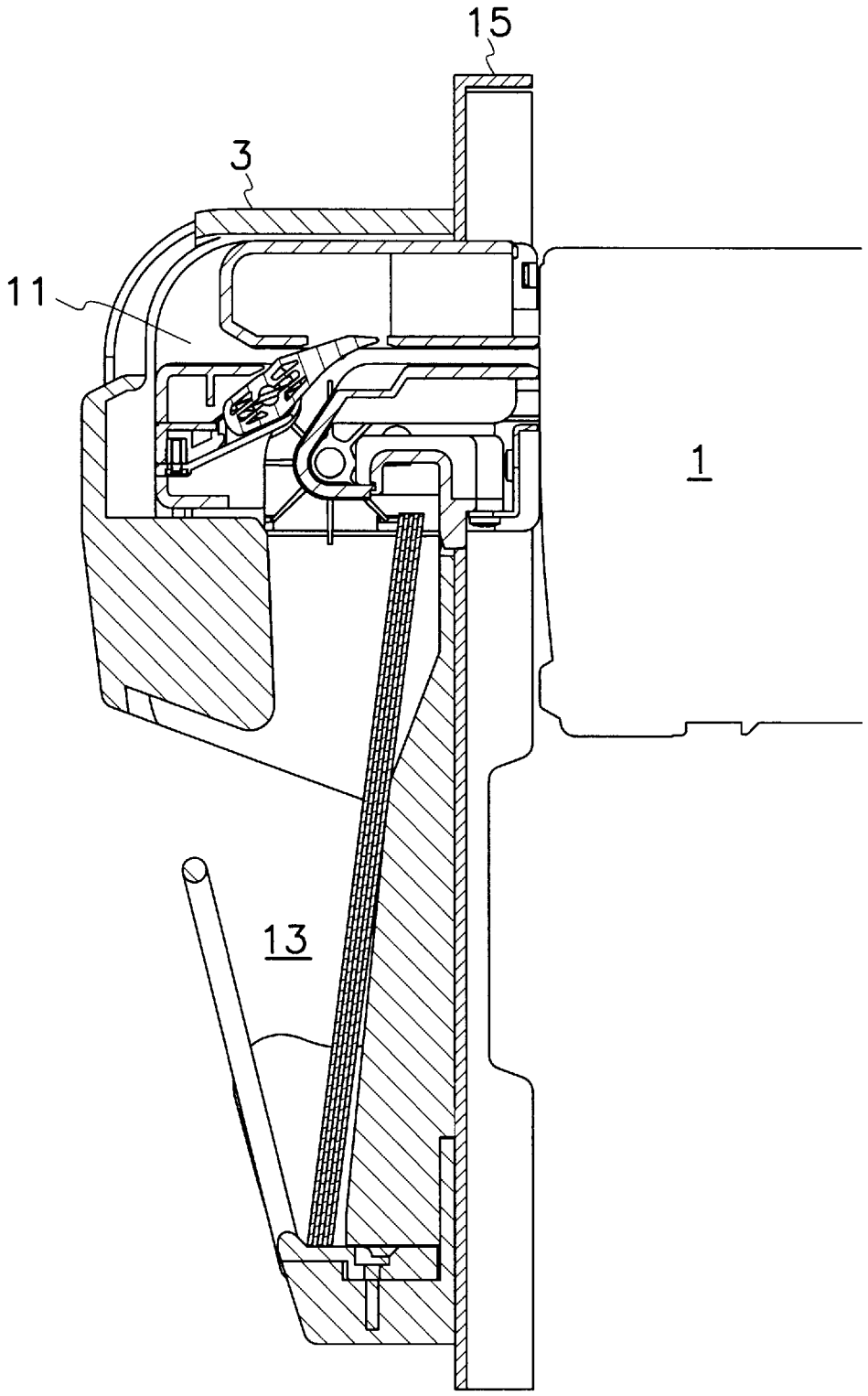
FIG. 10 is a sectional view of the document rack with the pocket for receiving bills that lean on a back wall of the rack.

As seen from FIGS. 1, 5 and 10, back wall 5 of housing 3 may be secured to a front side of door panel 15, and bill validator 1 is attached to a back side of door panel 15 so as to set front portion 2 of bill validator 1 in inner chamber 10 after it is passed through a hole 16 formed in door panel 15 and through notch 5*a* of back wall 5. As seen in FIG. 1, front portion 2 of bill validator 1 comprises an inlet port 11, an outlet port 12, a passageway 20 communicated with inlet port 11 to guide a bill moved between inlet port 11 and the back of passageway 20, a discharge pathway 21 that branches at a bifurcation 22 from passageway 20 to communicate with outlet port 12 and a deflection device 25 arranged at bifurcation 22 for directing the bill from passageway 20 toward outlet port 12. Deflection device 25 may be moved between the reception position of FIG. 7 for connecting inlet port 11 to passageway 20 while shutting down discharge pathway 21 from passageway 20 and the discharge position of FIG. 1 for connecting passageway 20 to discharge pathway 21 while shutting down inlet port 11 from passageway 20. A conveyor and a validation sensor (both not shown in the drawings) are provided in bill validator 1.

Figure 7:
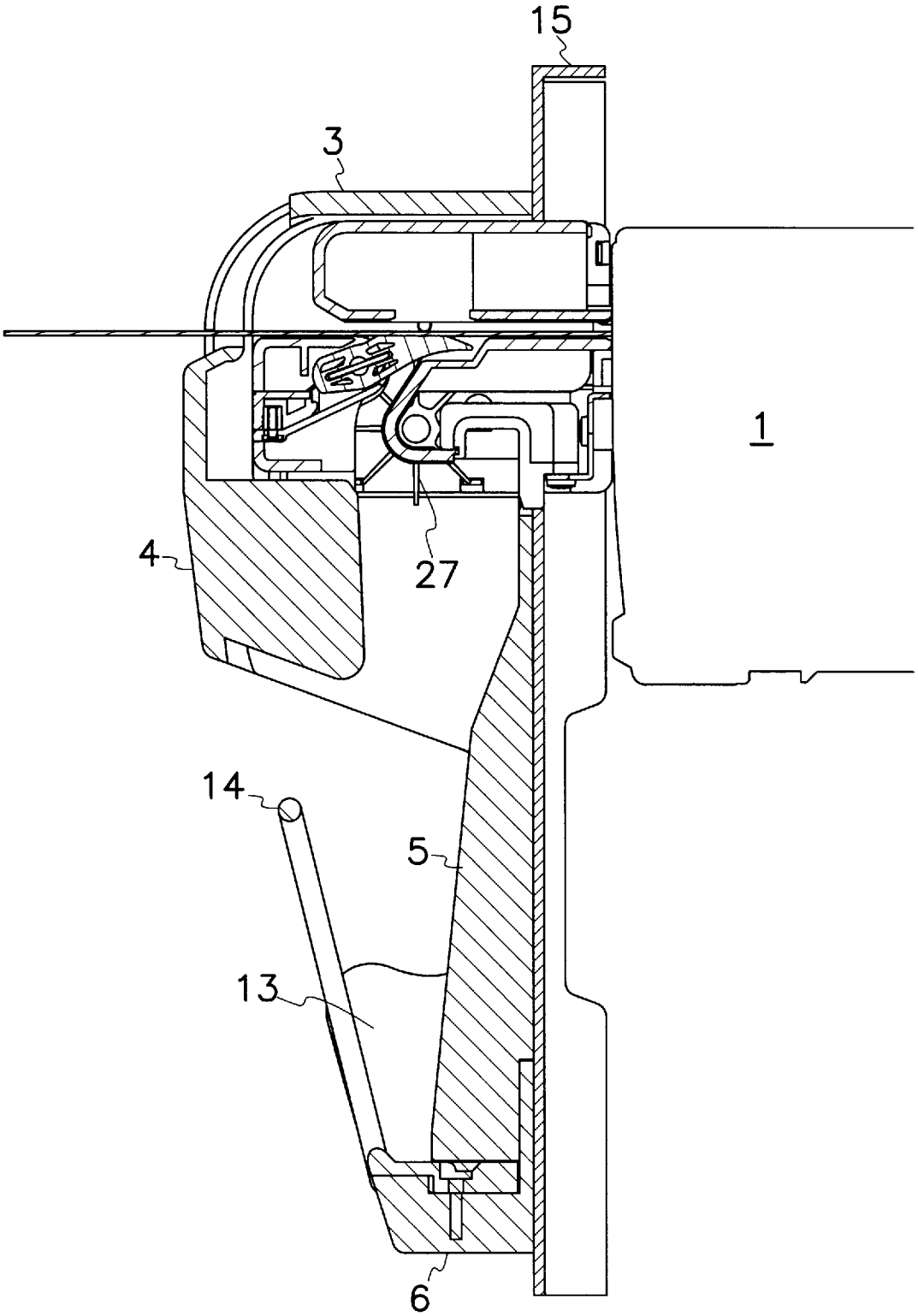
FIG. 7 is a sectional view of the document rack with a bill inserted into a bill validator attached to a back side of the panel.

As illustrated in FIGS. 11 to 14, deflection device 25 comprises a rotary shaft 30, a plurality of deflectors 31 mounted on rotary shaft 30 at regular intervals, a bell crank 32 attached to an end of rotary shaft 30 for integral rotation with rotary shaft 30, a tension spring 34 for constantly applying an elastic force on bell crank 32 to resiliently urge deflectors 31 toward a bottom surface 23 of passageway 20 so as to continuously keep deflector 31 in the reception position of FIG. 7. An actuator 26 such as a solenoid or motor is provided to have a reciprocating rod 28 whose outer end is pivoted by a pin 39 at one end of a lever 37 rotatably mounted on housing 3 by an axle 38 with the other end of lever 37 in contact to bell crank 32. Elastic force of tension spring 34 serves to resiliently keep reciprocating rod 28 of actuator 26 at the extended position, and simultaneously to keep deflector 31 in the reception position of FIG. 7 where deflectors 31 are in contact to bottom surface 23 of passageway 20 during deactivation of actuator 26 to allow users to slide bills into inlet port 11 of bill validator 1 through inlet opening 8.

When users insert bills into inlet port 11, bill validator 1 activates the conveyor and validator sensor to transport bills along passageway 20 and detect physical property of bills to automatically validate bills within bill validator 1. When the validator sensor considers inserted bills to be genuine, the conveyor transports them to a stacker (not shown) in bill validator 1. When the validator sensor does not consider inserted bills to be genuine, the conveyor returns them to inlet port 11 with deflectors 31 remaining at the reception position.

Figure 11:
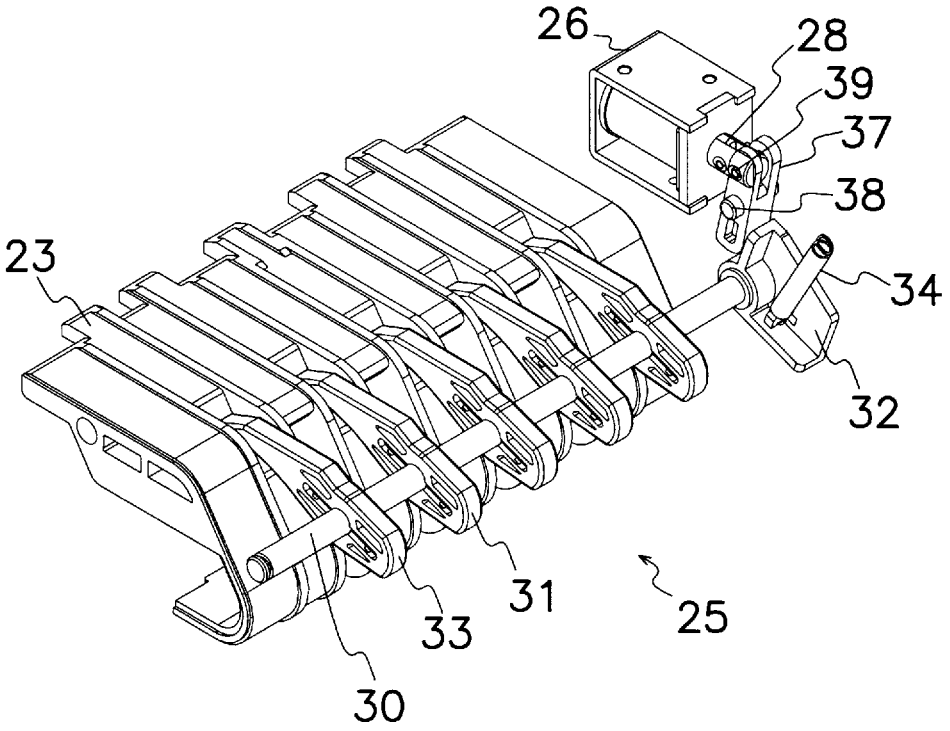
FIG. 11 is a perspective view of a deflection device with deflectors at the reception position.
Figure 12:
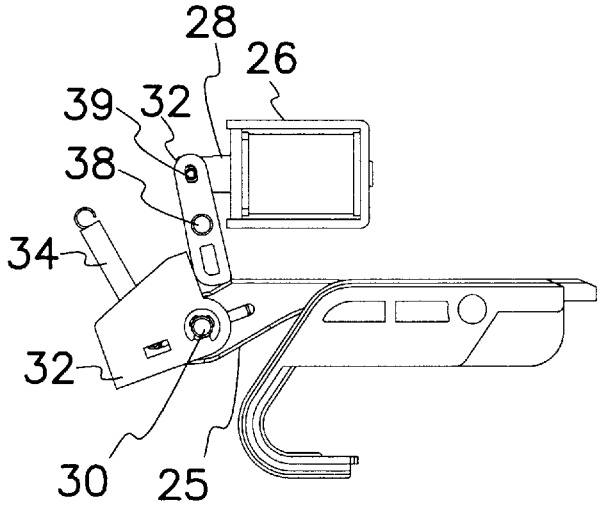
FIG. 12 is a side elevation view of the deflection device shown in FIG. 11.
Figure 13:
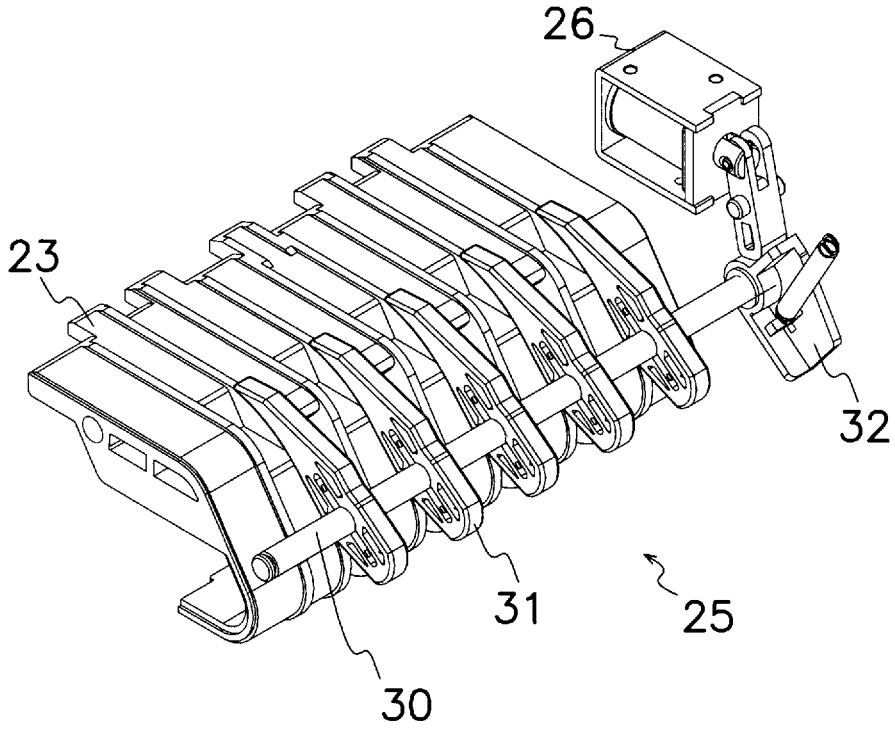
FIG. 13 is a perspective view of the deflection device with the deflectors at the discharge position.
Figure 14:
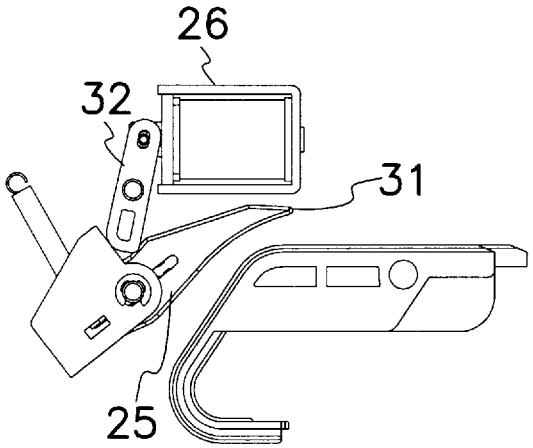
FIG. 14 is a side elevation view of the deflection device shown in FIG. 13.
Figure 15:
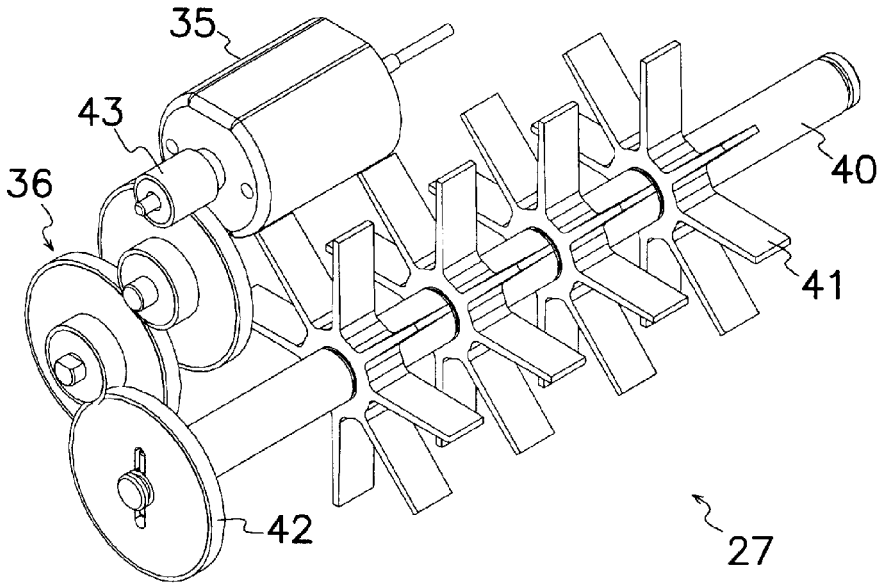
FIG. 15 is a perspective view of an impeller and a drive system thereof provided in the bill validator.

When actuator 26 is activated to inwardly pull reciprocating rod 28 to the retracted position, a lower end of lever 37 pushes bell crank 32 against elastic force of tension sprint 34 to rotate bell crank 32 and rotary shaft 30 to move deflectors 31 from the reception position of FIGS. 11 and 12 to the discharge position of FIGS. 13 and 14 away from bottom surface 23 of passageway 20.

Disposed opposite to deflector 31 is an impeller 27 that directs and transports bills from passageway 20 along discharge pathway 21 toward inner chamber 10. Impeller 27 has a drive shaft 40, a plurality of vanes 41 mounted on drive shaft 40 at regular intervals, a driven gear 42 secured at an end of drive shaft 40 and a drive motor 35 for driving driven gear 42 through a gear train 36 that has an input side meshed with a pinion 43 of drive motor 35 and an output side mesh with driven gear 42.

With deflector 31 retained at the reception position of FIG. 7 by means of elastic force of tension spring 34, a bill is inserted into inlet port 11 of validator 1 through inner chamber 10, and is inwardly delivered along passageway 20 by the conveyor over deflector 31 through the validator sensor to validate it because validator 1 accepts and stores inside only bills considered genuine and also reusable.

Figure 8:
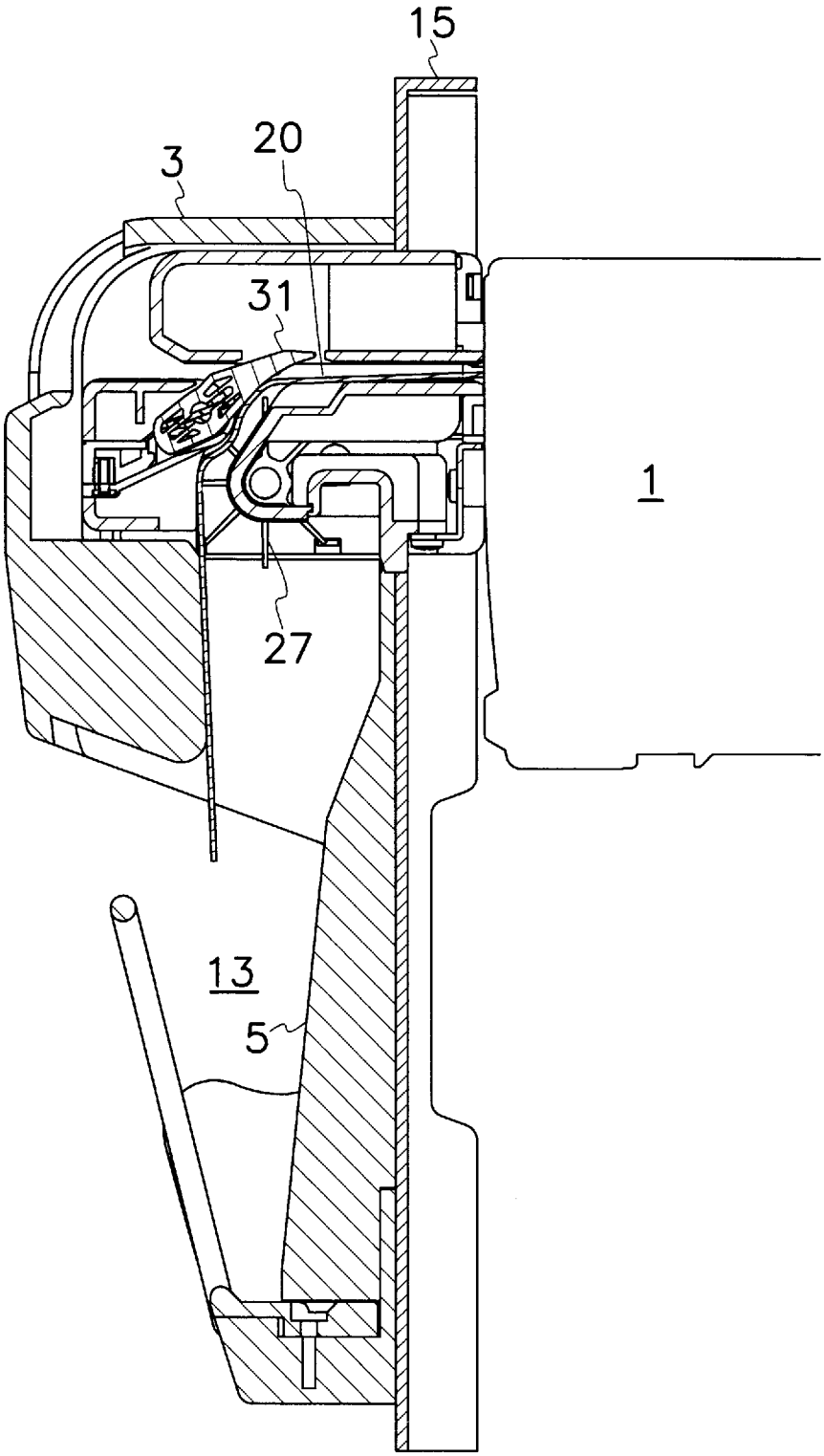
FIG. 8 is a sectional view of the document rack with a pocket for receiving a bill coming down from a front portion of the bill validator.
Figure 9:
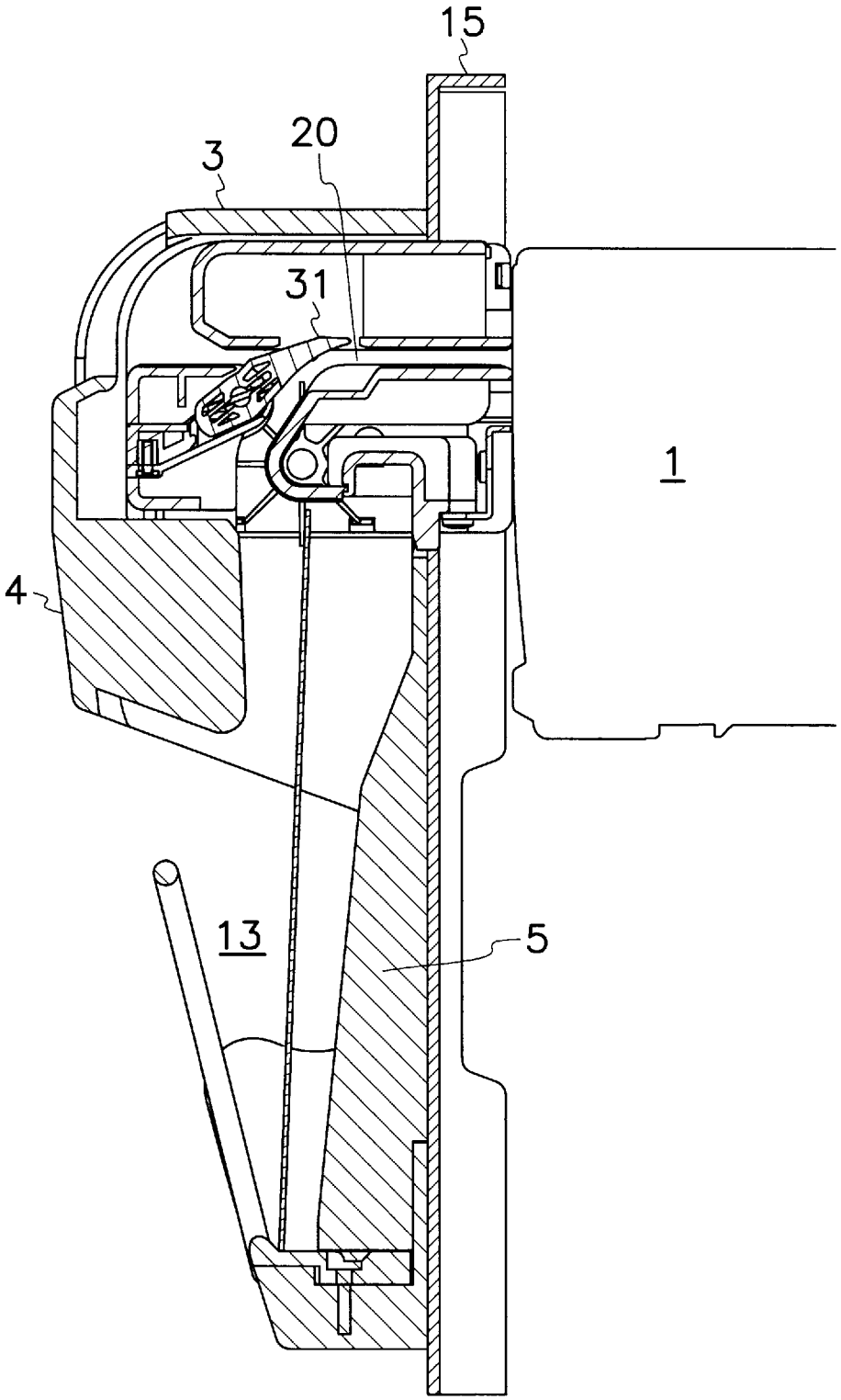
FIG. 9 is a sectional view of the document rack with the pocket for receiving the bill.

When bill validator 1 returns once accepted bills to outlet port 12 or dispenses charge with bill or bills from outlet port 12 for example in accordance with an instruction signal from a supervisory computer in a vending or bill handling machine, the conveyor begins to adversely transport bills from the back of passageway 20 toward outlet port 12, at the same time, actuator 26 is activated to move deflector 31 from the reception position to the discharge position while activating drive motor 35. As shown in FIG. 8, deflectors 31 divert bills through passageway 20 into discharge pathway 21 at bifurcation 22 to urge bills onto an inner surface of deflectors 31 by each tip of vanes 41 of impeller 27 so that each bill is moved along and between inner surface of deflectors 31 and an inner surface of front wall 4 of housing 3 to ensure the drop of bills into pocket 13 for dispensation as seen in FIGS. 9 and 10. Front wall 4 of housing 3 contributes to the prevention of bills from falling off pocket 13 when bills are discharged from outlet port 12 of bill validator 1.

In this way, the document rack may receive and retain bills dispensed from bill validator 1 to prevent scatter and contamination of issued bills. In addition, users can easily take out bills in a lump from the document rack for reuse of bills. Thus, the document rack makes it easier for users to handle bills discharged from document validator 1.

Figure 16:
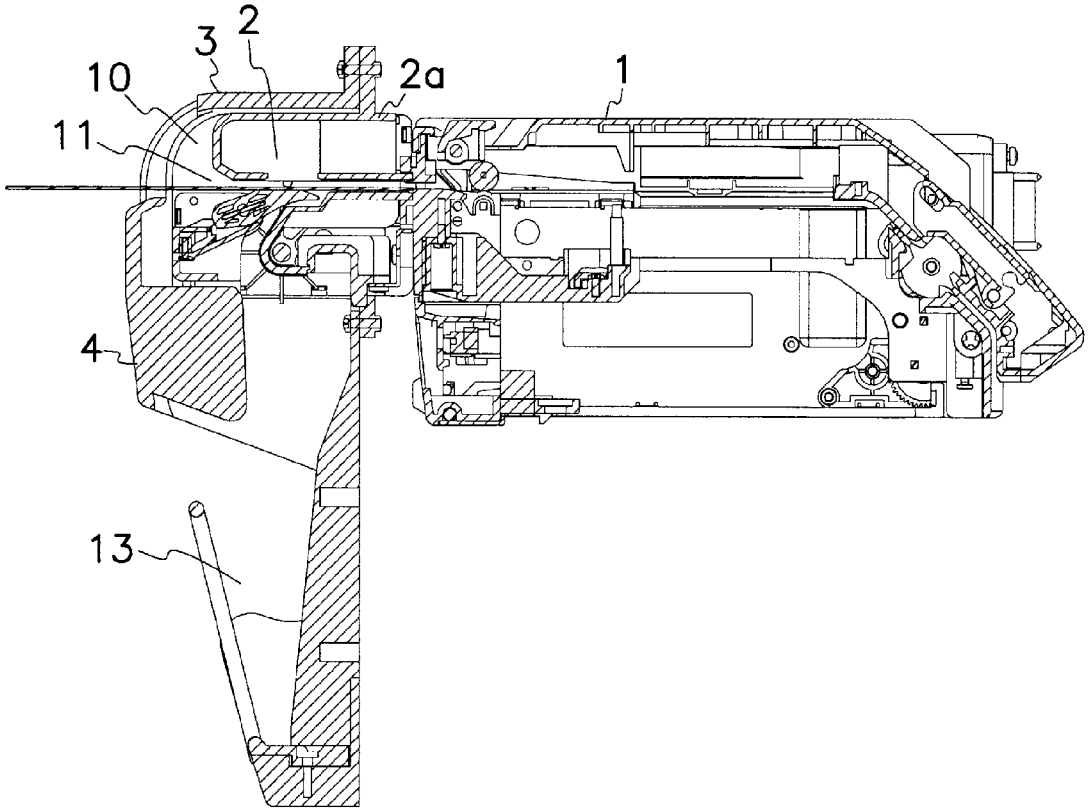
FIG. 16 is a sectional view of the document rack directly attached to a casing of the bill validator.

The foregoing embodiments of the prevent invention may be modified in various ways. For example, in place of panel 15, the document rack may be directly attached to a flange formed with a casing 2*a* that encases front portion 2 of bill validator 1 as shown in FIG. 16. The present invention is applicable to document racks used together with document validators that may dispense internally reserved documents from an outlet port of the validators.

The invention claimed is:

1. A document rack comprising a housing having:

a front wall (4) formed with an opening (7), a back wall (5) formed with a notch (5*a*), and a bottom wall (6) connected to a lower end of the back wall (5), wherein the housing (3) has an inner chamber (10) at the upper portion adapted to receive a front portion (2) of a document validator (1) and a pocket (13) at the lower portion adapted to receive documents discharged from the document validator (1), the front portion (2) of the document validator (1) may be arranged in the inner chamber (10) through the notch (5*a*) of the back wall (5), and the opening (7) formed on the front wall (4) comprises an inlet opening (8) through which the document is inserted into an inlet port (11) of the document validator (1) and a discharge opening (9) through which the documents in the inner chamber (10) are taken out of the housing (3).

2. The document rack of claim 1, wherein the front wall (4) of the housing (3) prevents the documents from falling off the inner chamber (10) when the documents are discharged from an outlet port (12) of the document validator (1).

3. The document rack of claim 1, wherein the housing (3) is attached to a front side of a shield (15) or to a casing (2*a*) of the document validator (1).

4. The document rack of claim 1, further comprising a shield (15) having front and back sides, wherein the housing (3) is attached to the front side of the shield (15), the document validator (1) is attached to the back side of the shield (15), the front portion (2) of the document validator (1) may be arranged in the inner chamber (10) through a hole (16) formed in the shield (15) and through the notch (5*a*) of the back wall (5).

5. The document rack of claim 1, wherein the document validator (1) accepts the documents considered genuine and also reusable.

6. The document rack of claim 1, wherein the front portion (2) of the document validator (1) comprises:

a passageway (20) communicated with an inlet port (11) of the front portion (2), a discharge pathway (21) that branches from a bifurcation (22) of the passageway (20) to communicate with an outlet port (12) and a deflector (25) arranged at the bifurcation (22), wherein the deflector (25) is movable between a reception position for connecting the inlet port (11) to the passageway (20) while shutting down the discharge pathway (21) from the passageway (20) and a discharge position for connecting the discharge pathway (21) to the passageway (20) while shutting down the inlet port (11) from the passageway (20).

7. The document rack of claim 6, further comprising an actuator (26) for moving the deflector (25) between the reception and discharge positions.

8. The document rack of claim 7, further comprising an impeller (27) disposed opposite to the deflector (25) for directing and transporting the document moved along the discharge pathway (21) toward the inner chamber (10).

* * * * *